US008141665B2

(12) United States Patent
Ganz

(10) Patent No.: US 8,141,665 B2
(45) Date of Patent: Mar. 27, 2012

(54) DRILL BITS WITH BEARING ELEMENTS FOR REDUCING EXPOSURE OF CUTTERS

(75) Inventor: Thomas Ganz, Bergen (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/637,333

(22) Filed: Dec. 12, 2006

(65) Prior Publication Data

US 2007/0151770 A1 Jul. 5, 2007

Related U.S. Application Data

(60) Provisional application No. 60/750,647, filed on Dec. 14, 2005.

(51) Int. Cl.
*E21B 10/36* (2006.01)
*E21B 10/42* (2006.01)
*E21B 10/46* (2006.01)

(52) U.S. Cl. ..... 175/432; 175/379; 175/430; 175/431

(58) Field of Classification Search ..... 175/327, 175/379, 430, 431, 432
See application file for complete search history.

(56) References Cited

U.S. PATENT DOCUMENTS

| | | | |
|---|---|---|---|
| 1,805,678 | A | 5/1931 | Smith |
| 1,923,487 | A | 8/1933 | Howard |
| 2,198,849 | A | 4/1940 | Waxier |
| 2,563,515 | A | 8/1951 | Brown |
| 2,624,549 | A | 1/1953 | Wallace |
| 2,684,835 | A | 7/1954 | Moore |
| 2,776,817 | A | 1/1957 | Gregory et al. |
| 3,058,535 | A | 10/1962 | Williams |
| 3,153,458 | A | 10/1964 | Short |

(Continued)

FOREIGN PATENT DOCUMENTS

| | | | |
|---|---|---|---|
| EP | 0169683 | A2 | 1/1986 |

(Continued)

OTHER PUBLICATIONS

PCT International Search Report for PCT/US2006/047778 dated Jun. 4, 2007 (2 pages).

(Continued)

*Primary Examiner* — Cathleen Hutchins
(74) *Attorney, Agent, or Firm* — TraskBritt

(57) ABSTRACT

A bearing element for a rotary, earth boring drag bit effectively reduces an exposure of at least one adjacent cutting element by a readily predictable amount, as well as a depth-of-cut (DOC) of the cutter. The bearing element has a substantially uniform thickness across substantially an entire area thereof. The bearing element also limits the amount of unit force applied to a formation so that the formation does not fail. The bearing element may prevent damage to cutters associated therewith, as well as possibly limit problems associated with bit balling, motor stalling and related drilling difficulties. Bits including the bearing elements, molds for forming the bearing elements and portions of bodies of bits that carry the bearing elements, methods for designing and fabricating the bearing elements and bits including the same, and methods for drilling subterranean formations are also disclosed. The design and drilling methods include selecting a formation to be drilled, calculating a desired DOC and the strength of the formation, and calculating a height or thickness of a bearing element that may limit the DOC and the unit force applied to the formation.

16 Claims, 6 Drawing Sheets

U.S. PATENT DOCUMENTS 3,303,894 A 2/1967 Varney
3,308,896 A 3/1967 Henderson
3,536,150 A 10/1970 Stebley
3,709,308 A 1/1973 Rowley et al.
3,779,323 A 12/1973 Horten et al.
3,915,246 A 10/1975 Sheshtawy
3,938,599 A 2/1976 Horn
4,006,788 A 2/1977 Garner
4,116,289 A 9/1978 Feenstra
4,176,723 A 12/1979 Arceneaux
4,253,533 A 3/1981 Baker, III
4,351,401 A 9/1982 Fielder
4,386,669 A 6/1983 Evans
4,499,958 A 2/1985 Radtke et al.
4,512,426 A 4/1985 Bidegaray
4,554,986 A 11/1985 Jones
4,718,505 A 1/1988 Fuller
4,763,737 A 8/1988 Hellnick
4,815,342 A 3/1989 Brett et al.
4,889,017 A 12/1989 Fuller et al.
4,932,484 A 6/1990 Warren et al.
4,942,933 A 7/1990 Barr et al.
4,981,184 A 1/1991 Knowlton et al.
4,982,802 A 1/1991 Warren et al.
4,991,670 A 2/1991 Fuller et al.
5,010,789 A 4/1991 Brett et al.
5,033,560 A 7/1991 Sawyer et al.
5,042,596 A 8/1991 Brett et al.
5,090,492 A * 2/1992 Keith ..... 175/408
5,111,892 A 5/1992 Sinor et al.
5,131,478 A 7/1992 Brett et al.
5,199,511 A 4/1993 Tibbitts et al.
5,222,566 A 6/1993 Taylor et al.
5,244,039 A * 9/1993 Newton et al. ..... 175/431
5,265,685 A 11/1993 Keith et al.
5,303,785 A 4/1994 Duke
5,314,033 A 5/1994 Tibbitts
5,388,649 A 2/1995 Ilomaki
5,402,856 A 4/1995 Warren et al.
5,433,280 A 7/1995 Smith
5,437,343 A 8/1995 Cooley et al.
5,447,208 A 9/1995 Lund et al.
5,505,273 A 4/1996 Azar et al.
5,531,281 A 7/1996 Murdock
5,544,550 A 8/1996 Smith
5,549,171 A 8/1996 Mensa-Wilmot et al.
5,558,170 A 9/1996 Thigpen et al.
5,582,258 A 12/1996 Tibbitts et al.
5,595,252 A 1/1997 O'Hanlon
5,607,025 A 3/1997 Mensa-Wilmot et al.
5,651,421 A 7/1997 Newton et al.
5,653,300 A 8/1997 Lund et al.
5,663,512 A 9/1997 Schader et al.
5,720,357 A 2/1998 Fuller et al.
5,730,234 A 3/1998 Putot
5,738,178 A 4/1998 Williams et al.
5,839,329 A 11/1998 Smith et al.
5,873,422 A 2/1999 Hansen et al.
5,937,958 A 8/1999 Mensa-Wilmot et al.
5,957,006 A 9/1999 Smith
5,979,576 A 11/1999 Hansen et al.
6,073,518 A 6/2000 Chow et al.
6,089,123 A 7/2000 Chow et al.
6,123,161 A 9/2000 Taylor
6,142,250 A 11/2000 Griffin et al.
6,200,514 B1 3/2001 Meister
6,209,420 B1 4/2001 Butcher et al.
6,246,974 B1 6/2001 Jelley et al.
6,298,930 B1 * 10/2001 Sinor et al. ..... 175/428
6,321,862 B1 11/2001 Beuershausen et al.
6,408,958 B1 6/2002 Isbell et al.
6,427,792 B1 * 8/2002 Roberts et al. ..... 175/431
6,460,631 B2 * 10/2002 Dykstra et al. ..... 175/57
6,568,492 B2 5/2003 Thigpen et al.
6,575,256 B1 6/2003 Doster
6,581,671 B2 6/2003 Butcher et al.
6,659,199 B2 * 12/2003 Swadi ..... 175/57
6,779,613 B2 8/2004 Dykstra et al.
6,823,952 B1 11/2004 Mensa-Wilmot et al.
6,883,623 B2 * 4/2005 McCormick et al. ..... 175/408
6,904,983 B2 6/2005 Thigpen et al.
6,935,441 B2 8/2005 Dykstra et al.
7,096,978 B2 8/2006 Dykstra et al.
7,237,628 B2 * 7/2007 Desai et al. ..... 175/406
7,360,608 B2 * 4/2008 Brackin et al. ..... 175/57
7,395,882 B2 7/2008 Oldham et al.
7,413,032 B2 8/2008 Krueger
7,814,990 B2 10/2010 Dykstra et al.
7,814,997 B2 10/2010 Aliko et al.
2001/0030063 A1 * 10/2001 Dykstra et al. ..... 175/57
2001/0030065 A1 * 10/2001 Beuershausen et al. ..... 175/327
2002/0121393 A1 * 9/2002 Thigpen et al. ..... 175/431
2003/0029642 A1 * 2/2003 Dykstra et al. ..... 175/57
2004/0244540 A1 12/2004 Oldham et al.
2004/0245022 A1 12/2004 Izaguirre et al.
2004/0245024 A1 12/2004 Kembaiyan
2005/0211475 A1 9/2005 Mirchandani et al.
2005/0230150 A1 10/2005 Oldham et al.
2007/0017710 A1 * 1/2007 Achilles et al. ..... 175/432
2008/0308321 A1 12/2008 Aliko et al.
2010/0276200 A1 11/2010 Schwefe et al.
2011/0114392 A1 5/2011 Dykstra et al.

FOREIGN PATENT DOCUMENTS

EP 0532869 B1 9/1997
EP 0 874 128 A2 10/1998
EP 0822318 B1 6/2002
EP 1 236 861 A 9/2002
GB 2190120 B1 11/1987
GB 2273946 A 7/1994
GB 2326659 A 12/1998
GB 2329203 A 3/1999
GB 2 370 592 A 7/2002

OTHER PUBLICATIONS

1995 Hughes Christensen Drill Bit Catalog, p. 31.
Hughes Christensen Bit Drawing dated May 29, 1997—HC Part No. CC201918.
Hughes Christensen Bit Drawing dated Sep. 18, 1996—HC Part No. CW 210655.
Hughes Christensen Bit Drawing dated Sep. 18, 1996—HC Part No. CS205023.
Hughes Christensen Bit Drawing dated Sep. 9, 1996—HC Part No. CC201718.
Search Report of the UK Patent Office, dated Dec. 7, 2000, for Application No. GB0020134.3.
Search Report of the Belgian Patent Office, dated Aug. 14, 2001, for Application No. BE20000528.
Smith Diamond Drill Bit brochure, bit type M-21 IADC M646, 2 pages, circa 1990's.
Maurer, William C., Advanced Drilling Techniques, 1980, pp. 541 and 568, The Petroleum Publishing Company, Tulsa, Oklahoma.
Fabian, Robert T., Confined compressive strength analysis can improve PDC bit selection, Oil & Gas Journal, May 16, 1994, 5 pages.
Taylor, M.R., et al., High Penetration Rates and Extended Bit Life Through Revolutionary Hydraulic and Mechanical Design in PDC Drill Bit Development, SPE 36435, presented at the SPE Annual Technical Conference and Exhibition, held in Denver, Colorado, Oct. 6-9, 1996, 14 pages.
Spaar, J.R., et al., Formation Compressive Strength Estimates for Predicting Drillability and PDC Bit Selection, SPE/IADC 29397, presented at the SPE/IADC Drilling Conference held in Amsterdam, Feb. 29-Mar. 2, 1995.
Williams, J.L., et al., An Analysis of the Performance of PDC Hybrid Drill Bits, SPE/IADC 16117, presented at the SPE/IADC Drilling Conference, held in New Orleans, LA, on Mar. 15-18, 1987.
Drill Bit Developments, The Institution of Mechanical Engineers, Offshore Engineering Group, seminar held Apr. 26, 1989, in Aberdeen, Scotland.
Counterclaim-Defendants' Amended Invalidity Contentions Pursuant to Patent Rule 3-3, signed by James A. Jorgensen, Feb. 8, 2008, Filed in Civil Action No. 6:06-CV-222 (LED) in the United Stated District Court for the Eastern District of Texas, Tyler Division, 19 pages (nonmaterial portions redacted).
Christensen Diamond Compact Bit Manual, 1982, 89 pages.
Expert Report of Mark E. Nussbaum, Dated Jan. 7, 2008, Filed in Civil Action No. 6:06-CV-222 (LED) in the United Stated District Court for the Eastern District of Texas, Tyler Division, 57 pages (nonmaterial portions redacted).
Plaintiffs' First Amended Reply to Baker Hughes Oilfield Operations, Inc.'s and Baker Hughes, Inc.'s First Amended Answer and Counterclaims and Plaintiffs' Counterclaims for Declaratory Judgment of Patent Invalidity, Non-Infringement, and Unenforceability, Signed by J. Mike Amerson, dated Feb. 23, 2007, filed in Civil Action No. 6:06-CV-222 (LED) in the United Stated District Court for the Eastern District of Texas, Tyler Division, 11 pages. (nonmaterial portions redacted).
Baker Hughes' Use of a Drill Bit Embodying the Alleged Inventions of the Asserted Claims of the 930 Patent Prior to Aug. 26, 1998, Expert Report of Mark Thompson, Jan. 18, 2008, Filed in Civil Action No. 6:06-CV-222 (LED) in the United Stated District Court for the Eastern District of Texas, Tyler Division, 5 pages (nonmaterial portions redacted).
DOCC bit—surface test, Memorandum from Wayne Hansen, dated May 11, 1998, 2 pages, Proprietary Material Subject to Protective Order—Document Filed Separately by Express Mail on Aug. 20, 2008, Pursuant to M.P.E.P. Section 724 With Petition Unde r 37 CFR Section 1.59.
Hansen, Wayne, Depth of Cut Control Feature Phase I 81/2" G554A2, May 1998, 35 pages, Proprietary Material Subject to Protective Order—Document Filed Separately by Express Mail on August 20, 2008, Pursuant to M.P.E.P. Section 724 With Petition Unde r 37 CFR Section 1.59.
International Search Report for International Application No. PCT/US20081066947, mailed Mar. 11, 2008, 4 pages.
International Search Report for International Application No. PCT/US20101032370, mailed Jan. 3, 2011, 3 pages.
International Written Opinion for International Application No. PCT/US2010/032370, mailed Jan. 3, 2011, 3 pages.
Stipulated Motion for Dismissal With Prejudice, United States District Court for the Easter District of Texas, Tyler Division, Civil Action No. 6:06-cv-222 (LED), dated Jun. 25, 2008.
Order Re Stipulated Motion for Dismissal With Prejudice, United States District Court for the Easter District of Texas, Tyler Division, Civil Action No. 6:06-cv-222 (LED), dated Jun. 26, 2008.

* cited by examiner

DRILL BITS WITH BEARING ELEMENTS FOR REDUCING EXPOSURE OF CUTTERS

CROSS-REFERENCE TO RELATED APPLICATION

This application claims the benefit of U.S. Provisional Application No. 60/750,647, filed Dec. 14, 2005, the disclosure of which is hereby incorporated herein, in its entirety, by this reference.

BACKGROUND OF THE INVENTION

1. Field of the Invention

The present invention relates to rotary, earth boring drag bits for drilling subterranean formations, as well as to the operation of such bits. More specifically, the present invention relates to modifying the designs of bits to include bearing elements for effectively reducing the exposure of cutting elements, or cutters, on the crowns of the bits by a readily predictable amount, as well as for optimizing performance of bits in the context of controlling cutter loading or depth-of-cut.

2. State of the Art

Bits that carry polycrystalline diamond compact (PDC) cutting elements, or cutters, have proven very effective in achieving high rates of penetration (ROP) in drilling subterranean formations exhibiting low to medium compressive strengths. A PDC cutter typically includes a disc-shaped diamond "table" formed on and bonded under high-pressure and high-temperature conditions to a supporting substrate, which may be formed from cemented tungsten carbide (WC), although other cutter configurations and substrate materials are known in the art. Recent improvements in the design of hydraulic flow regimes about the face of bits, cutter design, and drilling fluid formulation have reduced prior, notable tendencies of such bits to "ball" by increasing the volume of formation material that may be cut before exceeding the ability of the bit and its associated drilling fluid flow to clear the formation cuttings from the face of the bit.

The body of a rotary, earth boring drag bit may be fabricated by machining a mold cavity in a block of graphite or another material and introducing inserts and cutter displacements into the machined cavities of the mold. The surfaces of the mold cavity define regions on the surface of the drill bit, while the cutter displacements and other inserts may define recesses on the face of the bit body and internal cavities within the bit body. Once any inserts and displacements have been positioned within the mold cavity, a particulate material, such as tungsten carbide, may be introduced into the cavity of the mold. Thereafter, an infiltrant, or binder, material may be introduced into the cavity to secure the particles to one another. The cutter displacements and other inserts may be removed from the bit body following the infiltration process, after which other elements, such as the cutters and hydraulic nozzles, may be assembled with and secured to the bit body.

The relationship of torque-on-bit (TOB) to weight-on-bit (WOB) may be employed as an indicator of aggressivity for cutters, with the TOB-to-WOB ratio corresponding to the aggressiveness with which a cutter is exposed or oriented relative to the crown of a bit or the cone of the crown. When cutters are placed in cavities that have been formed with standard cutter displacements, they may be exposed an aggressive enough distance that a phenomenon that has been referred to in the art as "overloading" may occur, even when a low WOB is applied to the drill string to which the bit is mounted. The occurrence of this phenomenon is more likely with more aggressive exposure or orientation of the cutters. Overloading is particularly significant in low compressive strength formations where a relatively great depth-of-cut (DOC) may be achieved at an extremely low WOB. Overloading may also be caused or exacerbated by drill string bounce, in which the elasticity of the drill string causes erratic, or inconsistent, application of WOB to the drill bit. Moreover, when bits with cutters that are carried by cavities are operated at excessively high DOC, more formation cuttings may be generated than can be consistently cleared from the bit face and directed back up the borehole annulus via junk slots on the face of the bit, which may lead to bit balling.

Another problem that may be caused when cutters located on the crown of a rotary, earth boring drill bit are overexposed may occur while drilling from a zone or stratum of higher formation compressive strength to a "softer" zone of lower compressive strength. As the bit drills from the harder formation into the softer formation without changing the applied WOB, or before a directional driller can change the WOB, the penetration of the PDC cutters and, thus, the resulting torque-on-bit (TOB) increases almost instantaneously and by a substantial magnitude. The abruptly higher torque may, in turn, cause damage to the cutters and/or the bit body. In directional drilling, such a change causes the tool face orientation (TFO) of the directional (measurement-while-drilling, or MWD, or a steering tool) assembly to fluctuate, making it more difficult for the directional driller to follow the planned directional path for the bit. Thus, it may be necessary for the directional driller to back off the bit from the bottom of the borehole to reset or reorient the tool face, which may take a considerable amount of time (e.g., up to an hour). In addition, a downhole motor, such as drilling fluid-driven Moineau-type motors commonly employed in directional drilling operations, in combination with a steerable bottomhole assembly, may completely stall under a sudden torque increase, possibly damaging the motor. That is, the bit may stop rotating, thereby stopping the drilling operation and necessitating that the bit be backed off from the borehole bottom to re-establish drilling fluid flow and motor output. Such interruptions in the drilling of a well can be time consuming and quite costly, especially in the offshore drilling environment.

So-called "wear knots" have been deployed behind cutters on the faces of rotary, earth boring drag bits in an attempt to provide enhanced stability in some formations, notably interbedded soft, medium and hard rock. Drill bits drilling such formations easily become laterally unstable due to the wide and constant variation of resultant forces acting on a bit due to engagement of such formations with the cutters. Wear knots comprise structures in the form of bearing elements projecting from the bit face. Conventionally, wear knots rotationally trail some of the cutters at substantially the same radial locations as the cutters, usually at positions from the nose of the bit extending down the shoulder, to locations that are proximate to the gage. A conventional wear knot may comprise an elongated segment having an arcuate (e.g., half-hemispherical, part-ellipsoidal, etc.) leading end, taken in the direction of bit rotation. A wear knot projects from the bit face a lesser distance than the projection, or exposure, of its associated cutter and typically has a width less than that of a rotationally leading, associated cutter and, consequently, than a groove that has been cut into a formation by that cutter. One notable deviation from such design approach is disclosed in U.S. Pat. No. 5,090,492, wherein so-called "stabilizing projections" rotationally trail certain PDC cutters on the bit face and are sized in relation to their associated cutters to purportedly snugly enter and move along the groove cut by the associated leading cutter in frictional, but purportedly non-cutting, relationship to the side walls of the groove.

The presence of bearing elements in the form of wear knots, while well-intentioned in terms of enhancing rotary drag bit stability, often fall short in practice due to deficiencies in the abilities of bit manufacturers to accurately position and orient the wear knots. Notably, rather than riding completely within a groove cut by an associated, rotationally leading cutter or portions thereof, conventional wear knot designs and placements may contact the uncut rock at the walls of the groove in which they travel, which may excite, rather than reduce, lateral vibration of the bit. Additionally, the areas of the bearing surfaces of the wear knots (i.e., the surface area of a portion of a wear knot that contacts the formation being drilled rotationally behind a cutter at a given DOC) are often difficult to calculate because of the typically half-hemispherical or part-ellipsoidal shapes thereof. Furthermore, the sizes and shapes of wear knots that are formed from hardfacing and that are applied by hand are often not consistent from one wear knot to another. If the bearing surfaces of wear knots on opposite sides of a bit are not almost exactly the same, the bit could be subjected to uneven forces that might result in vibration, uneven wear, or, possibly, cutter or bit failure.

Several patents that have been assigned to Baker Hughes Incorporated address some issues related to DOC, wear knots, and the like. Included among these patents, the disclosures of each of which are hereby incorporated herein, in their entireties, by this reference, are U.S. Pat. Nos. 6,200,514; 6,209,420; 6,298,930; 6,659,199; 6,779,613; and 6,935,441.

While some of the foregoing patents recognize the desirability to limit cutter penetration, or DOC, or otherwise limit forces applied to a borehole surface, the disclosed approaches do not provide a method or apparatus for controlling DOC in a manner that is easily and inexpensively adaptable across various product lines and applications.

BRIEF SUMMARY OF THE INVENTION

The present invention includes bearing elements for rotary, earth boring drag bits, bits that include bearing elements behind cutters on the crowns thereof, methods for designing and fabricating the bearing elements and bits, and drilling methods that employ the bearing elements to effectively reduce DOC.

A bearing element that incorporates teachings of the present invention limits the DOC or the effective extent to which PDC cutters, or other types of cutters or cutting elements (which are collectively referred to hereinafter as "cutters") are exposed on the face of a rotary, earth boring drag bit. A bearing element might be located proximate to an associated cutter, which may, among other locations, be set in the crown, or nose, region of the bit, including, without limitation, within the cone of the crown and on the face of the crown. A bearing element may have a substantially uniform thickness across substantially an entire area thereof. The thickness, or height, of the bearing element, which is the distance the bearing element protrudes from a face of the bit (e.g., a blade on which the bearing element is located) may correspond directly to an effective decrease in the exposure, or standoff, and hence, the DOC of one or more adjacent cutters. A bearing element may be configured to distribute a load attributable to WOB over a sufficient surface area on the bit face, blades or other bit body structure contacting the formation face at the borehole bottom (e.g., at least about 30% of the blade surfaces at the crown of the bit) so that the applied WOB might not exceed, or is approximately less than, the compressive strength of the formation. As a result, the bit does not substantially indent, or fail, the formation rock. As the DOC is reduced by the bearing element, the bearing element may also limit the unit volume of formation material (rock) removed by the cutters per each rotation of the bit to prevent one or more of over-cutting the formation material, balling the bit, and damage to the cutters. If the bit is employed in a directional drilling operation, the likelihood of tool face loss or motor stalling may also be reduced by the presence of a bearing element of the present invention behind cutters on the crown of the bit.

A method for fabricating a bit is also within the scope of the present invention. Such a method may account for the compressive strength of a specific formation to be drilled, as noted above, and include the formation of one or more bearing elements at locations that will provide a bit or its cutters with one or more desired properties.

While a variety of techniques may be used to fabricate a bearing element or a bit with a bearing element, such a method may include fabricating a mold for forming the bit. The mold is formed by milling a cavity that includes a crown-forming region with smaller cavities, or recesses, that are configured to receive standard preforms, or displacements. Other inserts may also be placed within the mold cavity. The mold cavity is milled in such a way that slots, or grooves, are formed in the crown-forming region (e.g., in the cone thereof or elsewhere within the crown-forming region) in communication with trailing ends of the smaller, displacement-receiving cavities. These slots may have substantially uniform depths across substantially the entire areas thereof. Each slot defines the location of a bearing element to be formed on the crown of a bit and has a depth that corresponds to the distance the amount of cutter exposure at an adjacent region of the crown is to be effectively reduced to effectively control the DOC that each adjacent cutter may achieve. An area of the slot may be sufficient to support the anticipated axial load, or WOB, to prevent the cutters from digging into the formation beyond their intended DOC or so that the compressive strength of the expected formation to be drilled is not exceeded. Together, the mold cavity, the displacements, and any other inserts within the mold cavity define the body of a bit. Once a mold cavity has been formed and includes desired features, and cutter displacements and any other inserts have been positioned therein, a bit body may be formed, as known in the art (e.g., by introducing particulate material and infiltrant into the mold cavity). The displacements may then be removed from the bit body, leaving pockets that are configured to receive the cutters, which are subsequently assembled with and secured to the bit body.

According to another aspect, the present invention includes methods for drilling subterranean formations, which methods include using bits with bearing pads that effectively reduce the exposures of cutters on the crowns or in the cones of the bits.

Methods for designing bearing elements include selecting a formation to be drilled, calculating a desired DOC and the strength of the formation, and calculating the height or thickness of a bearing element that will limit the DOC and the unit force applied to the formation.

Other features and advantages of the present invention will become apparent to those of ordinary skill in the art through consideration of the ensuing description, the accompanying drawings, and the appended claims.

DETAILED DESCRIPTION

Figure 1:
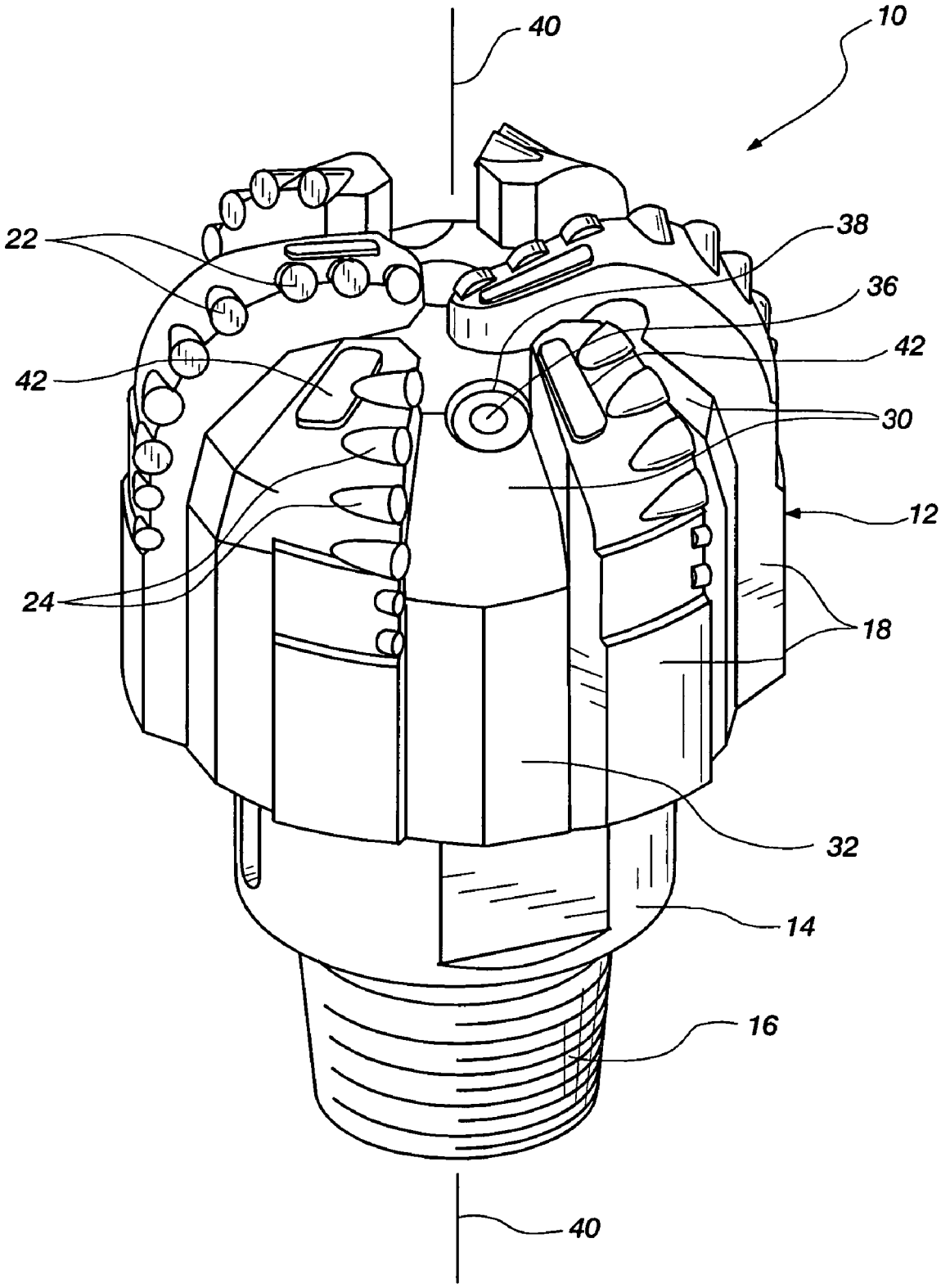
FIG. 1 is a perspective view of an example of a rotary earth boring drag bit that includes bearing pads that incorporate teachings of the present invention, with the bit in an inverted orientation relative to its orientation when drilling into a formation.

FIG. 1 of the drawings depicts a rotary drag bit 10 that includes a plurality of cutters 24 (e.g., PDC cutters) bonded by their substrates (diamond tables and substrates not shown separately for clarity), as by brazing, into pockets 22 (see also FIG. 2) in blades 18, as is known in the art with respect to the fabrication of so-called impregnated matrix, or, more simply, "matrix," type bits. Such bits include a mass of particulate material (e.g., a metal powder, such as tungsten carbide) infiltrated with a molten, subsequently hardenable binder (e.g., a copper-based alloy). It should be understood, however, that the present invention is not limited to matrix-type bits, and that steel body bits and bits of other manufacture may also be configured according to the present invention. The exterior shape of a diametrical cross section of the bit taken along the longitudinal axis 40, or axis of rotation, of bit 10 defines what may be termed the "bit profile" or "crown profile." See also FIG. 8. The end of drag bit 10 may include a shank 14 secured to the "matrix" bit body. Shank 14 may be threaded with an API pin connection 16, as known in the art, to facilitate the attachment of drill bit 10 to a drill string (not shown).

Internal fluid passages of bit 10 lead from a tubular shank at the upper, or trailing end, of bit 10 to a plenum extending into the bit body, to nozzle orifices 38. Nozzles 36 that are secured in nozzle orifices 38 provide fluid courses 30, which lie between blades 18, with drilling fluid. Fluid courses 30 extend to junk slots 32, which extend upwardly along the sides of bit 10, between blades 18. Formation cuttings are swept away from cutters 24 by drilling fluid expelled by nozzles 36, which moves generally radially outward through fluid courses 30, then upward through junk slots 32 to an annulus between the drill string (not shown) from which bit 10 is suspended, and on up to the surface, out of the well.

A plurality of bearing elements 42 may reside on the portions of blades 18 located at a crown, or nose, of bit 10. By way of non-limiting example, bearing elements 42 may be at least partially located on portions of blades 18 that are located within the cone of the crown of bit 10. Bearing element 42, which may be of any size, shape, and/or thickness that best suits the need of a particular application, may lie substantially along the same radius from axis 40 as one or more other bearing elements 42. The bearing element 42 or surfaces may provide sufficient surface area to withstand the axial or longitudinal WOB without exceeding the compressive strength of the formation being drilled, so that the rock does not unduly indent or fail and the penetration of PDC cutters 24 into the rock is substantially controlled.

As an example, the total bearing area of the bearing element 42 of an 8.5-inch-diameter bit configured as shown in FIG. 1 may be about 12 square inches. If, for example, the unconfined compressive strength of a relatively soft formation to be drilled by bit 10 is 2,000 pounds per square inch (psi), then at least about 24,000 lbs. WOB may be applied to the formation without failing or indenting it. Such WOB is far in excess of the WOB that may normally be applied to a bit in such formations (e.g., as little as 1,000 to 3,000 lbs., up to about up to about 5,000 lbs., etc.) without incurring bit balling from excessive DOC and the consequent cuttings volume which overwhelms the bit's ability to hydraulically clear the cuttings. In harder formations, with, for example, 20,000 to 40,000 psi compressive strengths, the collective surface area of the bearing elements of the bit may be significantly reduced while still accommodating substantial WOB applied to keep the bit firmly on the borehole bottom. When older, less sophisticated drill rigs are employed or during directional drilling, both circumstances that render it difficult to control WOB with any substantial precision, the ability to overload WOB without adverse consequences further distinguishes the superior performance of a bit that includes one or more bearing elements 42 according to the present invention. It should be noted that the use of an unconfined compressive strength of formation rock provides a significant margin for calculation of the required bearing area of bearing element 42 for a bit, as the in situ, confined, compressive strength of a subterranean formation being drilled is substantially higher. Thus, if desired, confined compressive strength values of selected formations may be employed in designing a bearing element with a total bearing area, as well as the total bearing area of a bit, to yield a smaller required bearing area, but which still advisedly provides for an adequate "margin" of excess bearing area in recognition of variations in continued compressive strengths of the formation to preclude substantial indentation and failure of the formation downhole.

In addition to serving as a bearing surface, the thicknesses or heights of bearing elements 42, or the distance they protrude from the surfaces of the blades 18, may determine the extent of the DOC, or the effective amount the exposure of cutters 24 is reduced vis-à-vis a formation to be drilled. By way of example only, each bearing element 42 may be configured to a certain height related to the desired DOC of its associated cutter or cutters 24. That is, as the height of bearing element 42 increases relative to the surface of blade 18, the DOC of its associated cutter or cutters 24 decreases. For example, a cutter 24 might have a nominal diameter of 0.75 inch that, when brazed into a pocket 22 in blade 18 may, without an adjacent bearing element 42, have a nominal DOC of 0.375 inch. By including a bearing element 42, the DOC of the 0.75-inch-diameter PDC cutter 24 might be reduced to as little as zero (0) inches. Of course, the DOC may be selected within a variety of ranges that depend upon the height of bearing element 42, or the distance that bearing element 42 protrudes from a surface of the crown of bit 10. Thus, bearing elements 42 eliminate the need to alter the depth of the cutter displacement-receiving cavities formed in a mold for the bit body, which permits the use of existing, standard displacements. Thus, the DOC of cutters 24 at the crown of a bit 10 and, hence, the aggressiveness of bit 10, may be quickly modified to the requirements of a particular formation without resorting to a redesign of the blade geometry or profile, which normally takes significant time and money to achieve.

A bit of the present invention may be fabricated by any suitable, known technique. For example, a bit may be formed through the use of a mold. The displacements and other inserts may be placed at precise locations within a cavity of the mold to ensure the proper placement of cutting elements, nozzles, junk slots, etc., in a bit body formed with the mold. Therefore, the cutter displacement-receiving cavities machined into the crown-forming region of a mold may have sufficient depths to support and hold displacements in position as particulate material and infiltrant are introduced into the mold cavity.

Figure 2:
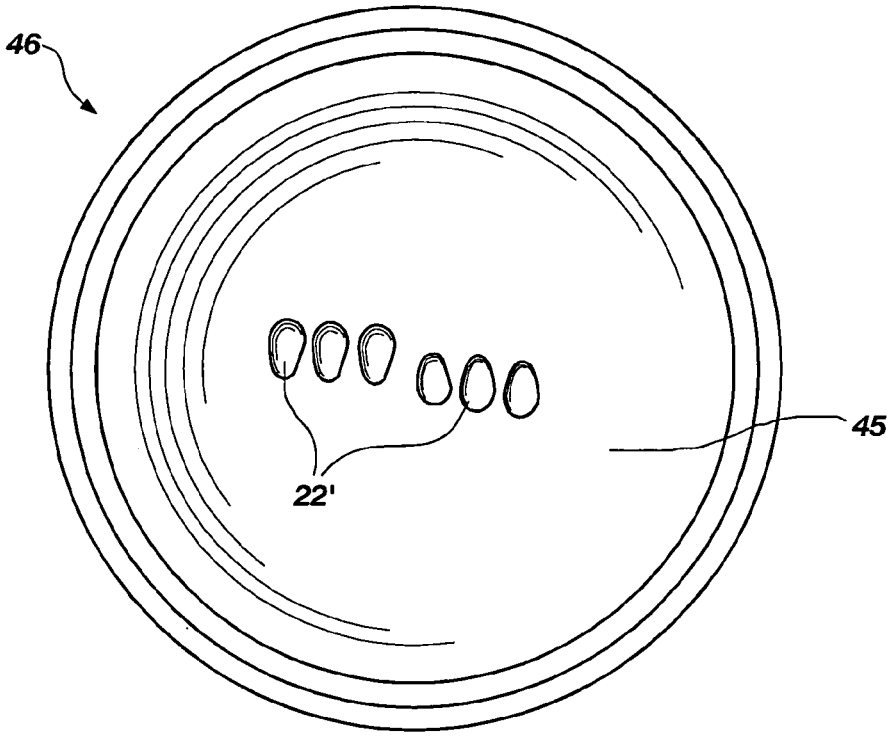
FIG. 2 is a schematic representation of a crown-forming surface of a mold for forming a rotary earth boring drag bit, the mold including milled cavities, or recesses for receiving preforms for cutters of the earth boring drag bit.
Figure 3:
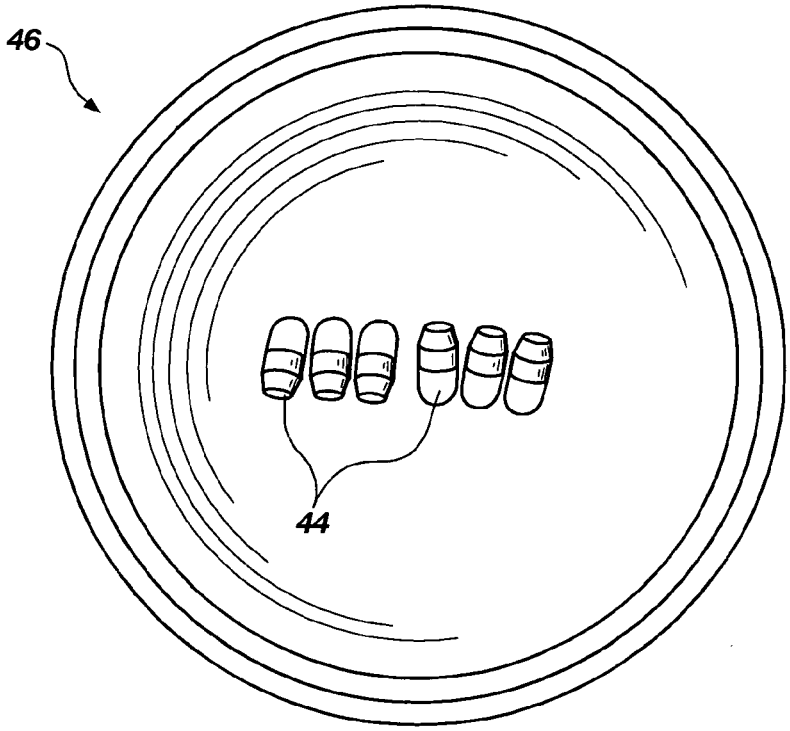
FIG. 3 is a schematic representation of the crown-forming surface of the mold shown in FIG. 2 with preforms, or inserts, for cutters installed in the milled cavities.

FIG. 2 is a representation of bit mold 46 from the perspective of one looking directly into a cavity 45 of mold 46. Mold 46 may be thought of as the negative of the bit (e.g., bit 10) to be formed therewith. The portion of mold 46 that is shown in FIG. 2 is a crown-forming region of the cavity 45 thereof. Small cavities 22' are shown that have been milled to hold the displacements for subsequently forming pockets within which the cutting elements that are to be located in the cone of the bit face are eventually inserted and secured. FIG. 3 is a representation of mold 46 from the same point of view, only, in this instance, displacements 44 have been inserted into small cavities 22'. As shown in FIGS. 4 through 7, slots, or grooves 48, 48', which subsequently form bearing elements 42 (FIG. 1), may be formed in mold 46, e.g., by milling the same into the surface of the cavity 45 of mold 46. Grooves 48, 48' and small cavities 22' may be formed, by way of non-limiting example, by hand milling or by a multi-axis (e.g., five-or seven-axis), milling machine under control of a computer. For example only, among other factors, the size, shape, area, and depth of each groove 48, 48' may be selected to achieve a desired DOC (i.e., aggressiveness) and bearing element area for a given application or formation as aforementioned.

Each groove 48, 48' has a substantially uniform depth across substantially an entire area thereof, regardless of the contour of the surface within which groove 48, 48' is formed. Each groove 48, 48' may, for example, have a width that is slightly greater than the widths of small cavities 22' in the mold 46 and, further, extend somewhat between adjacent small cavities 22'. Such configurations may provide greater bearing surface areas and may support a higher applied WOB than would otherwise be possible if the drill bit 10 lacked such features. Alternatively, each groove 48, 48' may have a width somewhat less than the widths of small cavities 22', in this instance about two-thirds (⅔) the total widths of small cavities 22'. In addition, grooves 48, 48' may not extend substantially between adjacent small cavities 22'. As a result, a groove 48, 48' with either of these features, or a combination thereof, would form a bearing element 42 that has a smaller surface area and, thus, that could support a relatively smaller applied WOB than a bearing element 42 with a greater surface area.

Mold 46 may include one groove 48, 48', or a plurality of grooves 48, 48'. If mold 46 includes a plurality of grooves 48, 48', the individual grooves 48, 48' may have the same dimensions as one another, or the individual grooves 48, 48' may have at least one dimension that differs from a corresponding dimension of another groove 48, 48'. For example, a mold 46 may include a first groove 48 with the larger dimension and surface area noted above, while another groove 48' may include smaller dimensions, as noted above. In addition, the depths of grooves 48, 48' may be the same, or differ from one groove 48 to another groove 48'. Furthermore, while mold 46 is depicted as including slots 48, 48' at particular locations merely for the sake of illustration, grooves 48, 48' may be formed elsewhere within mold 46 without departing from the scope of the present invention.

Figure 4:
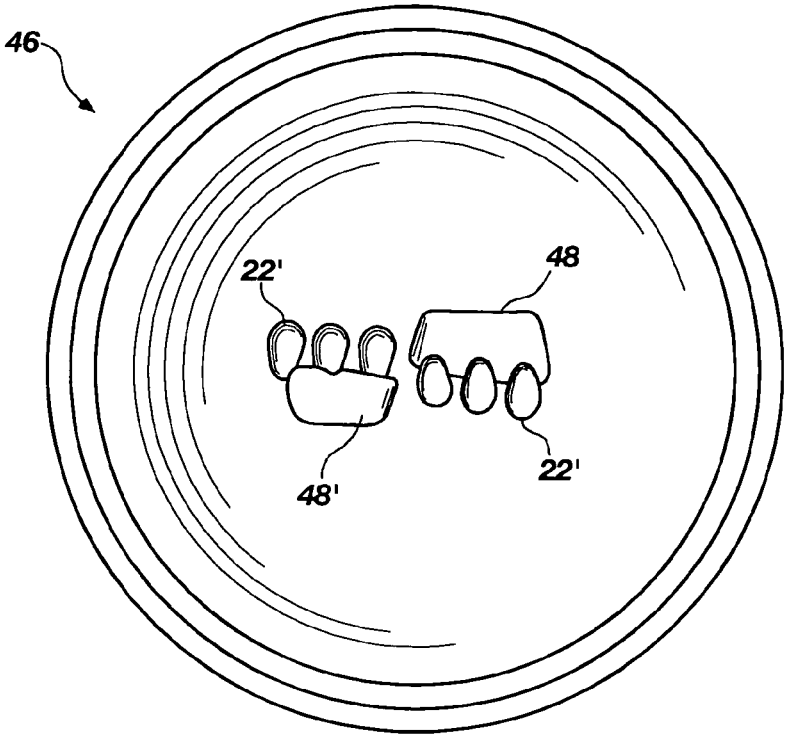
FIG. 4 is a schematic representation of the crown-forming surface of the mold with milled slots located at the trailing edges of at least some of the milled cavities for receiving the preforms or inserts.
Figure 5:
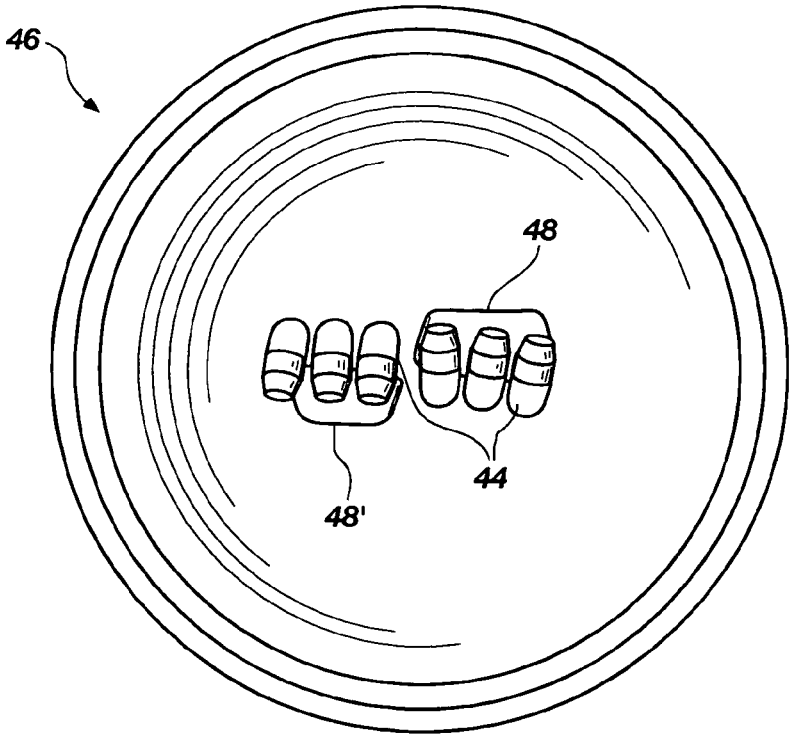
FIG. 5 is a schematic representation of the crown-forming surface of the mold of FIG. 4 with preforms, or inserts, in the milled cavities.
Figure 6:
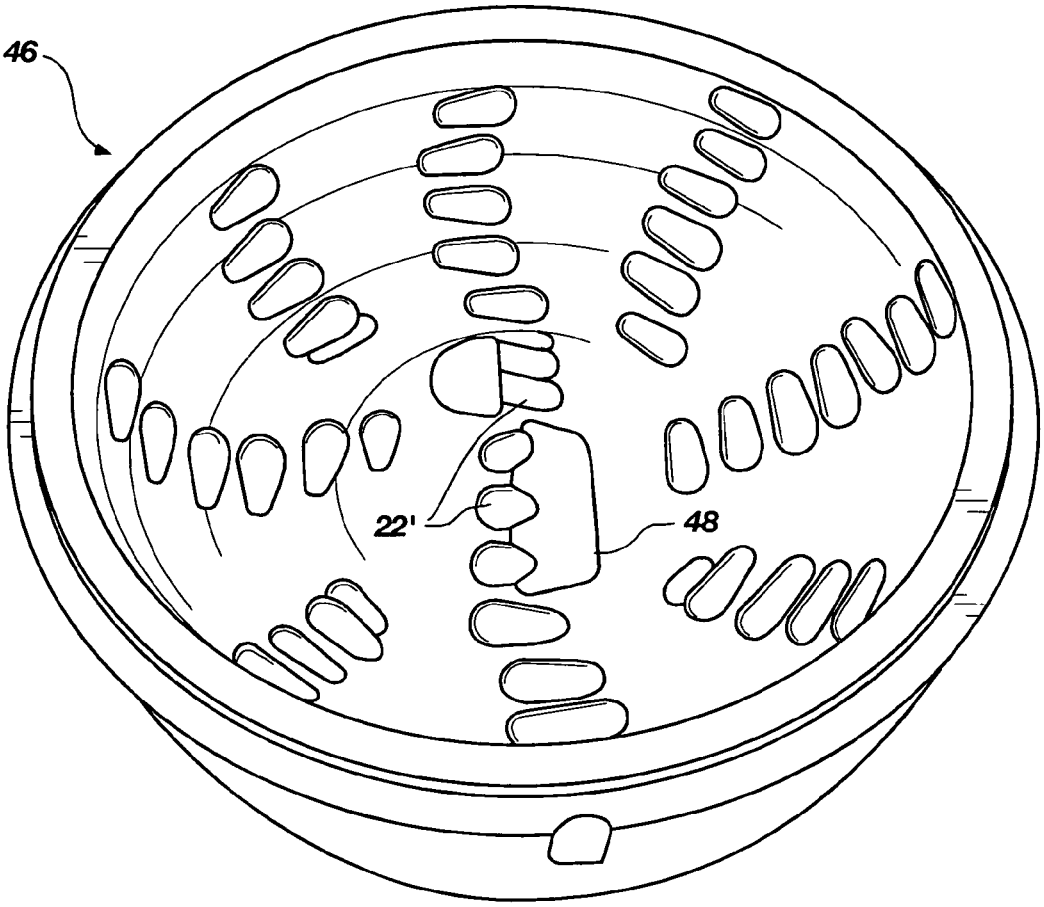
FIG. 6 is a perspective view of a crown-forming surface of a mold including the features depicted in FIG. 4.
Figure 7:
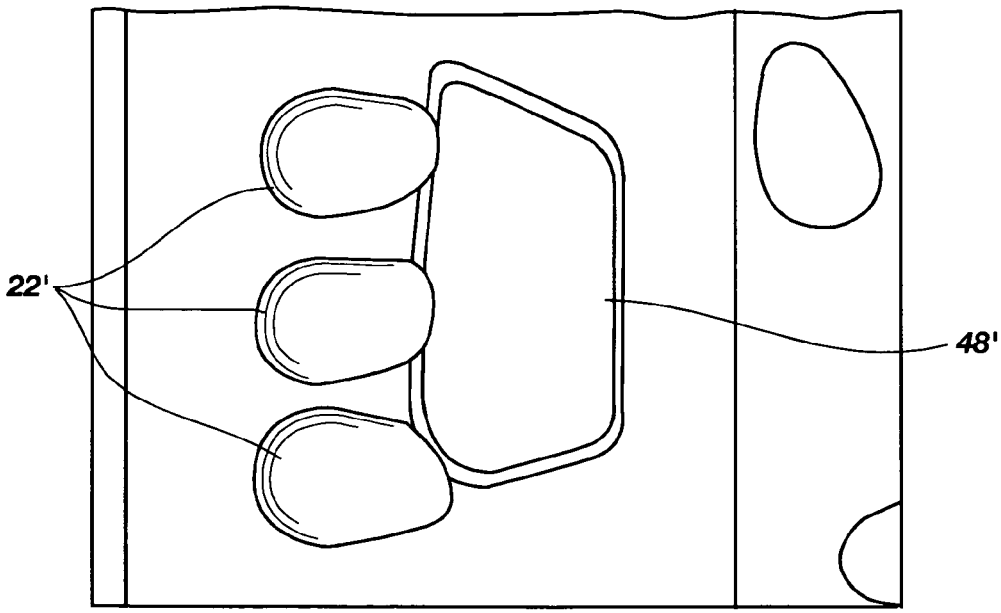
FIG. 7 is a close-up view of the milled cavities and milled slots of the portion of the bit illustrated in FIG. 6.

FIG. 5 shows mold 46 of FIG. 4 after displacements 44 have been installed in small cavities 22', with the associated examples of grooves 48 and 48'. Once displacements 44 have been installed within small cavities 22', bit 10 may be formed with mold 46 by any suitable process known in the art, including the introduction of a particulate material and the introduction of a binding agent, or binder or infiltrant, within cavity 45 of mold 46.

Figure 8:
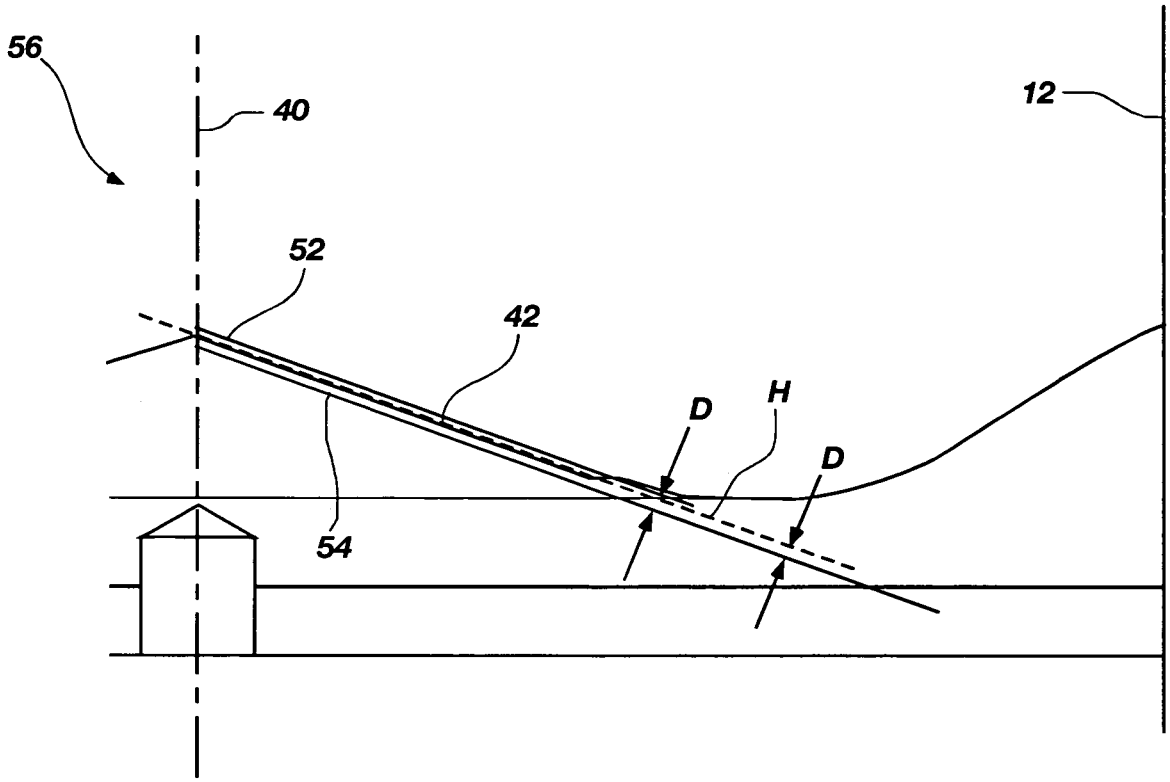
FIG. 8 is a schematic representation of a crown of a rotary earth boring drag bit that illustrates the relationship between DOC, crown profile, and cutter profile.

FIG. 8 illustrates a profile view 56 of an exemplary bit 10 designed in accordance accordance with teachings of the present invention. The crown profile 52 is the line that traces the profile of blades 18 from axis 40 to the gage radius 12, as also seen in FIG. 1. The cutter profile 54 traces the edges of cutters 24 as the bit is rotated around axis 40 and cutters 24 pass through the plane that corresponds to the page on which FIG. 8 appears. The distance between crown profile 52 and cutter profile 54 is the nominal depth-of-cut '(DOC), labeled D, absent the bearing element 42. However, the bearing element 42, as formed from slot or groove 48 of mold 46, as discussed above, may modify the DOC of cutters 24. In this instance, bearing element 42 extends beyond crown profile 52 a set distance H, and the DOC of cutters 24 is the distance between bearing element 42 and cutter profile 54, indicated by D'.

Of course, other techniques may be used to form a bit with one or more bearing elements. For example, a bit body or a portion thereof may be machined from a solid blank; formed by programmed material consolidation (e.g., "layered manufacturing," etc.) and infiltration processes, such as those disclosed in U.S. Pat. Nos. 6,581,671, 6,209,420, 6,089,123, 6,073,518, 5,957,006, 5,839,329, 5,544,550, 5,433,280, which have each been assigned to Baker Hughes Incorporated, the disclosures of each of which are hereby incorporated herein, in their entireties, by this reference; or by any other suitable bit fabrication process.

Figure 9:
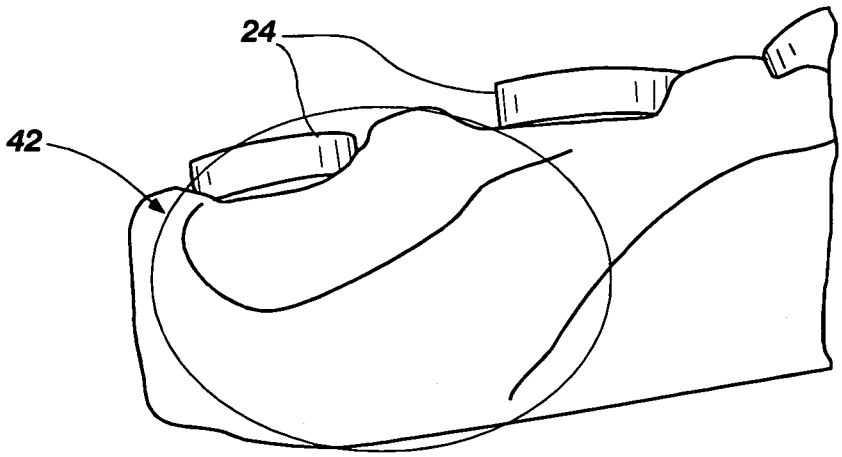
FIG. 9 is a close-up rear perspective view of a portion of a blade of a rotary earth boring drag bit that is located within a cone of the crown of the bit and that includes cutters and a bearing element located adjacent to a trailing edge of at least some of the cutters on the cone portion of the blade to effectively reduce an exposure of each adjacent cutter.
Figure 10:
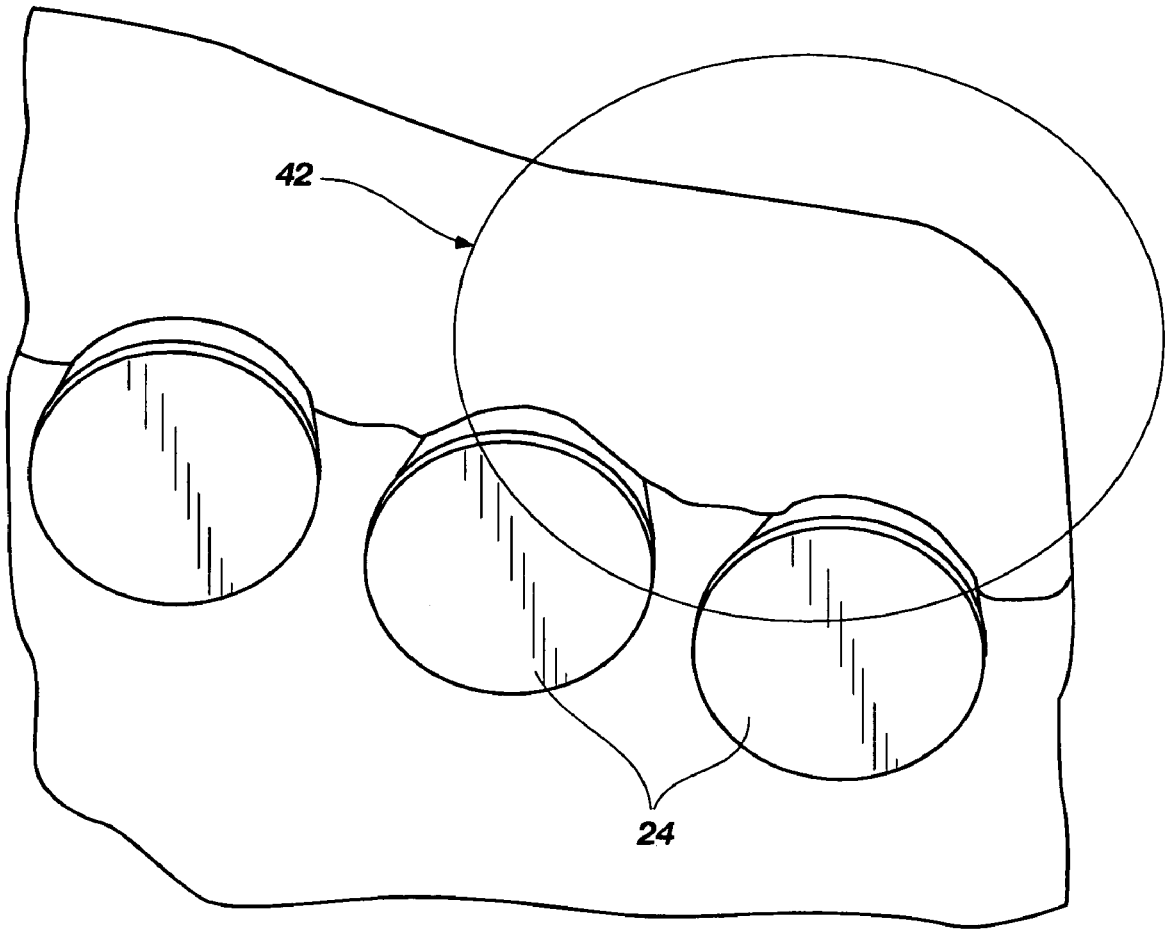
FIG. 10 is a close-up front perspective view of the portion of the rotary earth boring drag bit shown in FIG. 9.

A bit 10 embodying teachings of the present invention is shown in FIGS. 9 and 10. FIG. 9 provides a close-up view of a bearing element 42 of a bit 10. Cutters 24 are also visible in FIG. 9. Similar features are visible in FIG. 10. Bearing element 42 is visible from a different angle, as are cutters 24. The bearing element 42 extends laterally between laterally adjacent cutters 24 and abuts each of the laterally adjacent cutters 24 along a rotationally trailing end and at least a portion of opposing sides of each of the cutters 24.

With returned reference to FIGS. 1 and 8-10, a method for drilling a subterranean formation includes engaging a formation with at least one cutter 24, the exposure of which is limited by at least one bearing element 42, which may also limit the DOC of each cutter 24. One or more cutters 24 having DOCs limited by one or more bearing elements 42 may be positioned on a formation-facing surface of at least one portion, or region, of at least one blade 18 to render a cutter 24 spacing and cutter profile 54 exposure that will enable the bit 10 to engage the formation within a wide range of WOB without generating an excessive amount of TOB, even at elevated WOBs, for the instant ROP that the bit 10 is providing. That is, as aforementioned, the torque is related directly to the WOB applied. Using a bit 10 with bearing elements 42 that will limit the DOC by a predetermined, readily predictable amount and, hence, limit the torque applied to drill bit 10, decreases the likelihood that the torque might cause the downhole motor to stall or the tool face to undesirably change. Drilling may be conducted primarily with cutters 24, which have DOCs limited by one or more bearing elements 42, engaging a relatively hard formation within a selected range of WOB. Upon encountering a softer formation and/or upon applying an increased amount of WOB to bit 10, at least one bearing element 42 located proximate to at least one associated cutter 24 limits the DOC of the associated cutter 24 while allowing bit 10 to ride against the formation on bearing element 42, regardless of the WOB being applied to bit 10 and regardless of the WOB being applied to bit 10 and without generating an unacceptably high, potentially bit-damaging TOB for the current ROP.

Although the foregoing description contains many specifics and examples, these should not be construed as limiting the scope of the present invention, but merely as providing illustrations of some of the presently preferred embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions and modifications to the invention as disclosed herein and which fall within the meaning of the claims are to be embraced within their scope.

What is claimed is:

1. A rotary earth boring drag bit, comprising:

a body including a plurality of blades and a crown at an axially leading end of the body, the crown comprising at least a cone;

a plurality of cutters at the crown on at least one blade of the plurality of blades; and at least one bearing element positioned on the at least one blade, defining a bearing surface contained within the cone for disposition against an earth formation during drilling and adjacent at least two laterally adjacent cutters of the plurality of cutters on the at least one blade of the plurality of blades, the at least one bearing element including a quantity of material protruding above an axially leading portion of the at least one blade rotationally behind at least rotationally leading portions of the at least two laterally adjacent cutters, extending laterally between the at least two laterally adjacent cutters and abutting each of the at least two laterally adjacent cutters along a rotationally trailing end and at least a portion of opposing sides of each of the at least two laterally adjacent cutters, the at least one bearing element being configured to effectively reduce an exposure of and limit, under an axial load applied to the body, a depth-of-cut into the earth formation of the at least two laterally adjacent cutters.

2. The rotary earth boring drag bit of claim 1, wherein the bearing surface of the at least one bearing element protrudes a substantially uniform distance above the axially leading portion of the at least one blade.

3. The rotary earth boring drag bit of claim 1, wherein the at least two laterally adjacent cutters protrude a distance from the axially leading portion of the at least one blade and the at least two laterally adjacent cutters exhibit a lesser depth-of-cut, less than the distance, above the bearing surface.

4. The rotary earth boring drag bit of claim 1, wherein the at least one bearing element is configured to distribute a load attributable to weight-on-bit over an area of a surface of the earth formation to be drilled to prevent compression of the earth formation.

5. The rotary earth boring drag bit of claim 4, wherein the at least one blade comprises a plurality of blades, each blade having the at least one bearing element thereon, and the bearing elements are, in combination, configured to distribute the load in such a way that the load is about the same as or less than a compressive strength of the earth formation.

6. The rotary earth boring drag bit of claim 5, wherein the bearing elements are sized and shaped to, in combination, prevent the earth formation from being indented thereby during drilling of the earth formation.

7. The rotary earth boring drag bit of claim 5, wherein the bearing elements cover at least about 30% of an area of the crown.

8. The rotary earth boring drag bit of claim 1, wherein the at least one bearing element is configured to prevent at least one of over-cutting an earth formation, balling of the rotary earth boring drag bit, and damage to the plurality of cutters.

9. A rotary earth boring drag bit, comprising:

a body including a plurality of blades and a crown at an axially leading end of the body;

a plurality of cutters carried by a blade of the plurality of blades in a cone of the crown; and at least one bearing element including a quantity of material protruding above a portion of a surface of the blade in the cone of the crown, positioned in abutting relationship to, and extending laterally between, along at least portions of opposing sides of, and rotationally and laterally behind, at least some of the plurality of cutters so as to travel over and between paths that have been cut by the at least some of the plurality of cutters during use of the rotary earth boring drag bit without substantially extending into grooves cut by the at least some of the plurality of cutters, the at least one bearing element configured to distribute a load attributable to an axially directed weight-on-bit over an area of a surface of an earth formation to be drilled.

10. The rotary earth boring drag bit of claim 9, wherein the at least one bearing element is configured to distribute the load in such a way that the load is about the same as or less than a compressive strength of the earth formation.

11. The rotary earth boring drag bit of claim 9, wherein a size and a shape of the at least one bearing element are configured to prevent the at least one bearing element from indenting the earth formation during drilling of the earth formation.

12. The rotary earth boring drag bit of claim 9, wherein the at least one bearing element covers at least about 30% of an area of the crown.

13. A rotary earth boring drag bit, comprising:

a body including a plurality of blades of a crown comprising a cone at an axially leading end of the body;

a plurality of cutters carried by at least one blade of the plurality of blades in the cone of the crown; and at least one bearing element on the at least one blade of the body, substantially an entire area of the at least one bearing element protruding a substantially uniform distance from a surface of the at least one blade, the at least one bearing element positioned in the cone and extending in abutting relationship along opposing side portions of, and rotationally and laterally behind, at least two laterally adjacent cutters of the plurality of cutters so that the at least one bearing element travels over and between paths that have been cut by the at least two laterally adjacent cutters during use of the rotary earth boring drag bit and to extend laterally beyond the paths to distribute a load attributable to an axially applied weight-on-bit over areas of a surface of an earth formation located laterally adjacent to the paths while the plurality of cutters remove material from the earth formation to define the paths.

14. The rotary earth boring drag bit of claim 13, wherein the at least one bearing element is configured to tailor a depth-of-cut of each cutter of the plurality of cutters.

15. The rotary earth boring drag bit of claim 14, wherein the at least one bearing element is configured to distribute a load attributable to weight-on-bit in such a way that the load is about the same as or less than a compressive strength of the earth formation to be drilled with the rotary earth boring drag bit.

16. The rotary earth boring drag bit of claim 13, wherein the at least one bearing element covers at least about 30% of an area of the crown.

* * * * *